US008900063B2

(12) United States Patent
Lin

(10) Patent No.: US 8,900,063 B2
(45) Date of Patent: Dec. 2, 2014

(54) BABY SWING

(75) Inventor: Maohao Lin, Hong Kong (HK)

(73) Assignee: Wonderland Nurseygoods Company Limited, Central Hong Kong (HK)

( * ) Notice: Subject to any disclaimer, the term of this patent is extended or adjusted under 35 U.S.C. 154(b) by 175 days.

(21) Appl. No.: 13/237,613

(22) Filed: Sep. 20, 2011

(65) Prior Publication Data

US 2012/0083349 A1 Apr. 5, 2012

(30) Foreign Application Priority Data

Sep. 30, 2010 (CN) ..... 2010 1 0502915

(51) Int. Cl.
*A63G 9/16* (2006.01)
*A47D 13/10* (2006.01)

(52) U.S. Cl.
CPC ..... *A47D 13/105* (2013.01)
USPC ..... 472/119

(58) Field of Classification Search
CPC ..... A47D 13/105; A47D 9/00
USPC ..... 472/119, 118; 5/101
See application file for complete search history.

(56) References Cited

U.S. PATENT DOCUMENTS

| | | | | |
|---|---|---|---|---|
| 4,948,120 | A * | 8/1990 | Krueger et al. | 297/274 |
| 7,258,617 | B2 * | 8/2007 | Chen | 472/118 |
| 7,878,915 | B2 * | 2/2011 | Myers et al. | 472/119 |
| 2010/0062867 | A1 * | 3/2010 | Chen | 472/119 |

FOREIGN PATENT DOCUMENTS

| | | | |
|---|---|---|---|
| CN | 2772326 | Y | 4/2006 |
| CN | 201346063 | Y | 11/2009 |

* cited by examiner

*Primary Examiner* — Michael Dennis
(74) *Attorney, Agent, or Firm* — Banner & Witcoff, Ltd.

(57) ABSTRACT

A baby swing includes a pair of frames, a pair of connecting members, a pair of rotating members, a pair of booms, and a seat. The frames are interconnected by the connecting members. The rotating members are connected respectively and pivotally to the connecting members. Each of the booms has two ends connected respectively to a corresponding one of the rotating members and the seat. One of the two ends of each of the booms is connected pivotally to a corresponding one of the corresponding one of the rotating members and the seat.

5 Claims, 5 Drawing Sheets

BABY SWING

CROSS-REFERENCE TO RELATED APPLICATION

This application claims priority of Chinese Application No. 201010502915.4, filed on Sep. 30, 2010.

BACKGROUND OF THE INVENTION

1. Field of the Invention

This invention relates to infant recreational equipment, and more particularly to a baby swing.

2. Description of the Related Art

A conventional baby swing includes frames, rotating members, booms, and a seat. The frames are connected respectively to the booms by the rotating members. The seat is suspended on the frames by the booms. The rotating members are connected respectively and pivotally to the frames. Each of the booms has two ends connected respectively and fixedly to the corresponding rotating member and the seat.

During use, left and right sides of the frames may be different in height, e.g., due to movement of the center of the gravity of the baby seated on the seat, thereby reclining the seat. In such a state, swinging movement of the seat can result in application of a torque to each of the rotating members and, thus, breakage of the rotating members, so that the service life of the baby swing is reduced. Furthermore, when either of the rotating members is broken, the seat is dropped.

Therefore, there is a need for preventing breakage of rotating members when the seat is reclined.

SUMMARY OF THE INVENTION

The object of this invention is to provide a baby swing that can prevent breakage of rotating members due to application of a torque thereto when a seat is reclined.

According to this invention, there is provided a baby swing comprising a pair of frames, a pair of connecting members, a pair of rotating members, a pair of booms, and a seat, the frames being interconnected by the connecting members, the rotating members being connected respectively and pivotally to the connecting members, each of the booms having two ends connected respectively to a corresponding one of the rotating members and the seat, wherein one of the two ends of each of the booms is connected pivotally to a corresponding one of the corresponding one of the rotating members and the seat.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
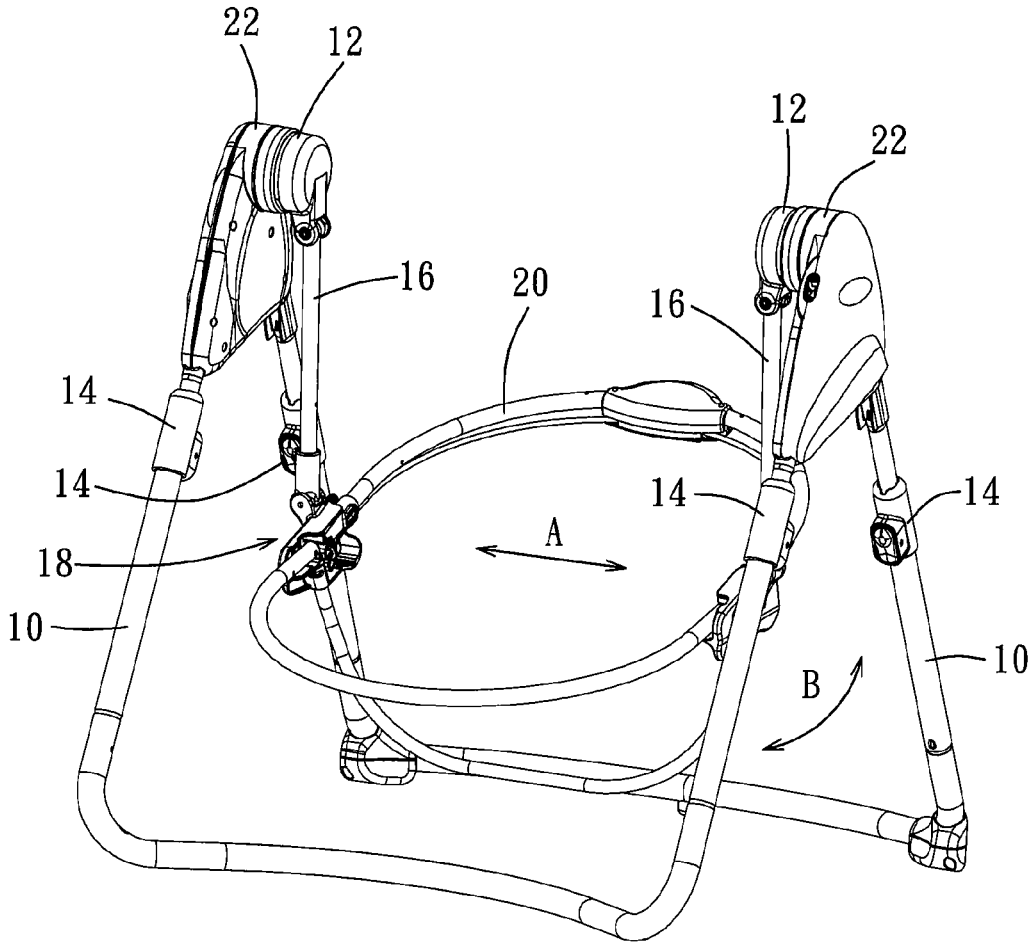
FIG. 1 is a perspective view of the preferred embodiment of a baby swing according to this invention.
Figure 2:
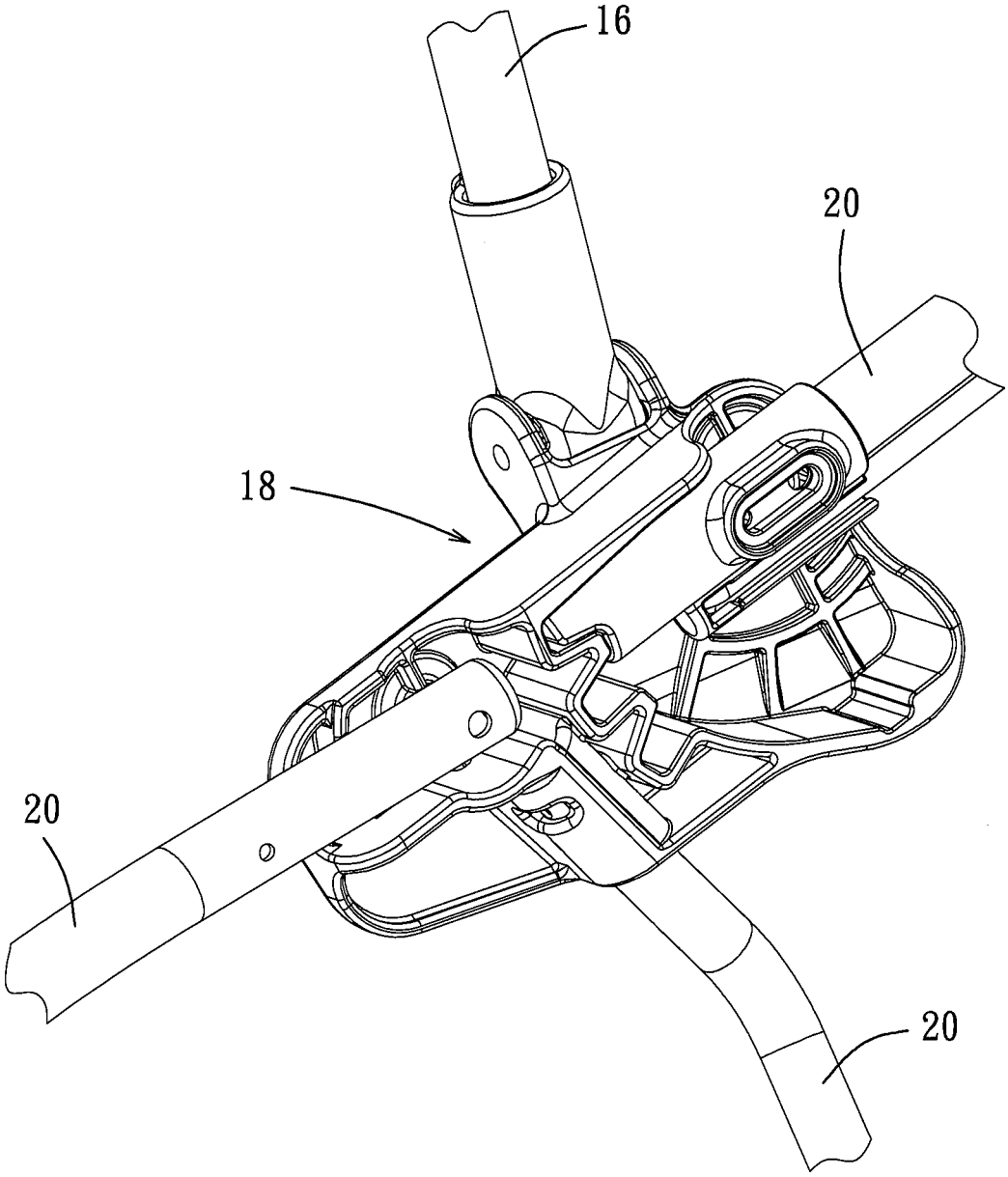
FIG. 2 is an enlarged view of a portion 1 of FIG. 1.

Referring to FIGS. 1 and 2, the preferred embodiment of a baby swing according to this invention includes a pair of frames 10, a pair of connecting members 22, a pair of rotating members 12, four height-adjusting devices 14, a pair of booms 16, a pair of pivotal connection units 18, and a seat 20. Each of the frames 10 is generally U-shaped. The frames 10 are interconnected by the connecting members 22. The rotating members 12 are connected respectively and pivotally to the connecting members 22. Each of the frames 10 is associated with two of the height-adjusting devices 14. Each of the booms 16 has an upper end connected pivotally to the corresponding rotating member 12, and a lower end connected pivotally to the seat 20. As such, the seat 20 is suspended on the frames 10.

It should be noted that, as long as the upper ends of the booms 15 are connected respectively and pivotally to the rotating members 12 or the lower ends of the booms 15 are connected pivotally to the seat 20, when the heights of left and right sides of the frames 10 are different, it can be ensured that breakage of the rotating members 12 due to application of a torque thereto can be prevented. In this manner, the service life of the baby swing can be increased, and dropping of the seat 20 can be avoided to promote safety during use of the baby swing. Each of the upper and lower ends of each of the booms 16 is connected pivotally to a corresponding one of the rotating members 12 and the seat 20 in a left-to-right direction (A), such that the seat 20 can swing forwardly and rearwardly in a direction (B).

Figure 3:
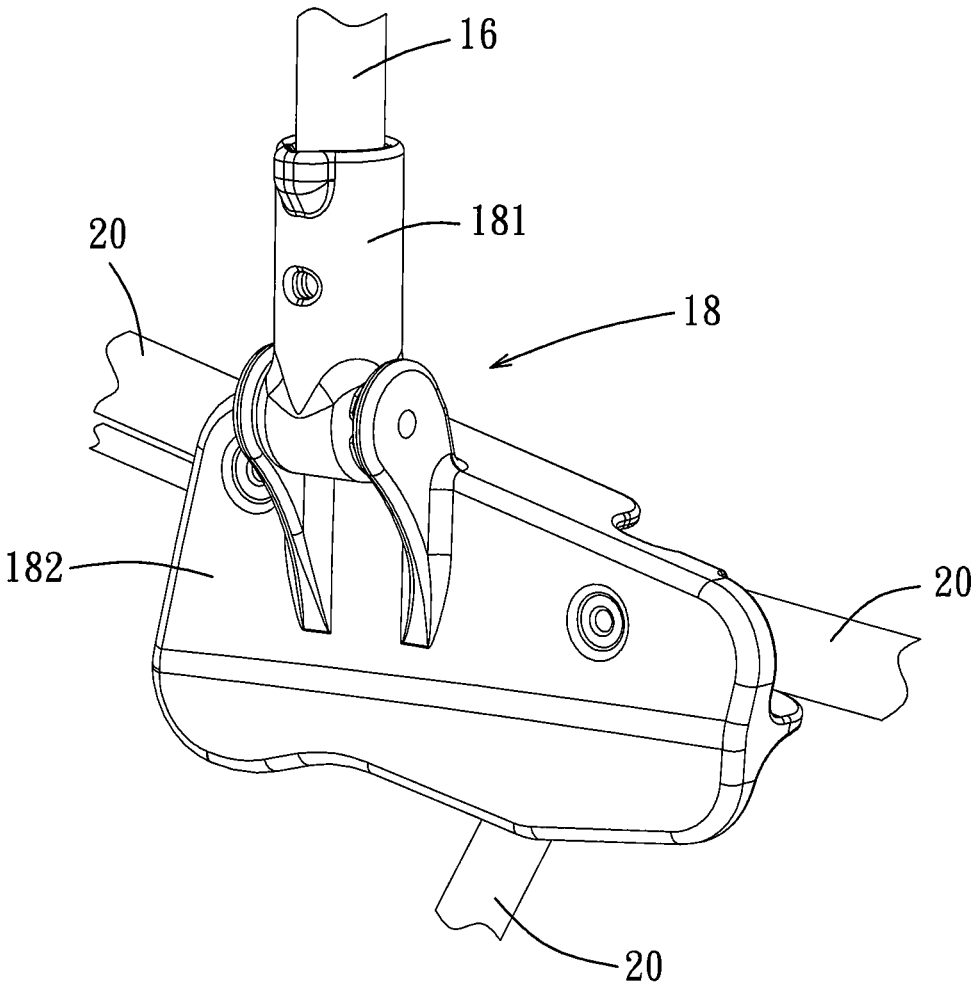
FIG. 3 is a perspective view of the portion 1 of FIG. 1, viewed at another angle.
Figure 4:
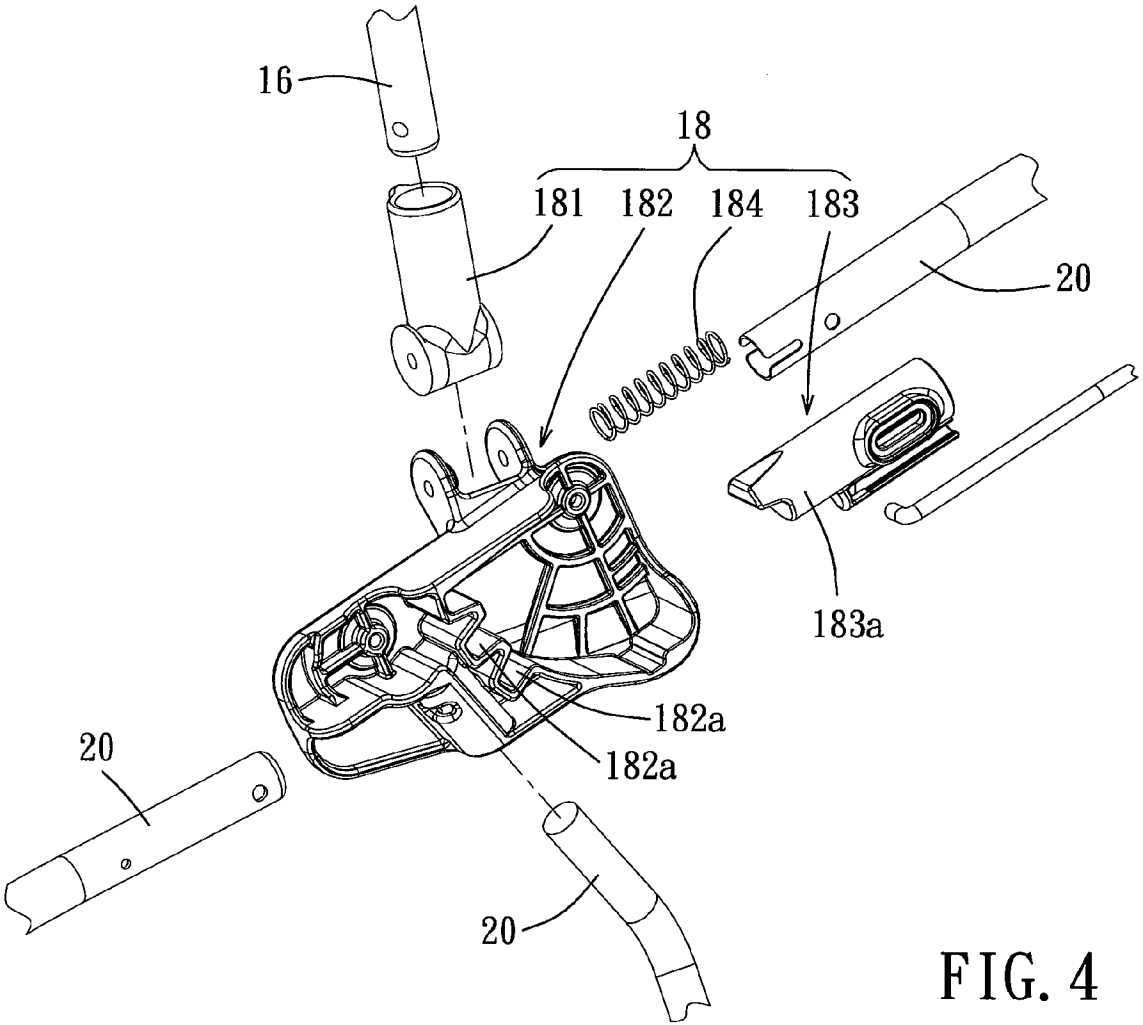
FIG. 4 is an exploded perspective view of the portion 1 of FIG. 1.
Figure 5:
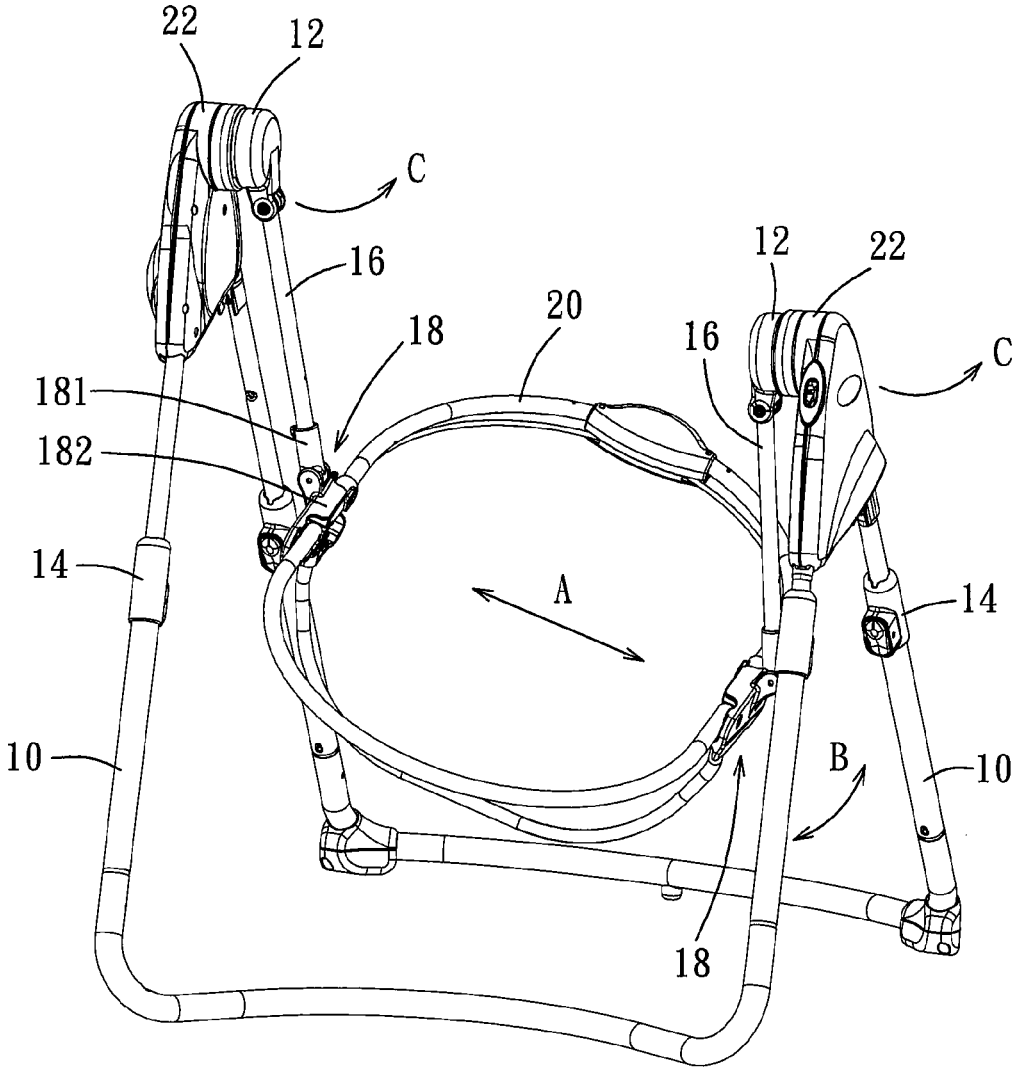
FIG. 5 is a view similar to FIG. 1 but illustrating that the heights of left and right sides of frames are different.

With further reference to FIGS. 3, 4, and 5, each of the pivotal connection units 18 includes a connecting piece 181, an engaging member 182, a mounting member 183, and a resilient member 184. The connecting piece 181 is mounted to the corresponding boom 16, and is connected pivotally to the engaging member 182. The engaging member 182 is connected to the mounting member 183. The mounting member 183 is mounted to the seat 20. The resilient member 184 is disposed within the mounting member 183. The connecting piece 181 is tubular. The booms 16 are inserted respectively into the connecting pieces 181 of the pivotal connection units 18. The resilient member 184 is a spring.

With particular reference to FIG. 4, the engaging member 182 is formed with a plurality of engaging grooves 182*a*. The mounting member 183 has an insert portion 183*a* inserted into a selected one of the engaging grooves 182*a*. The resilient member 184 is disposed for biasing the insert portion 183*a* into the selected engaging groove 182*a*.

The operation principle of this invention will now be described in the following. As shown in FIG. 5, when the heights of the left and right sides of the frames 10 are different, e.g., due to improper height adjustment of the frames 10 or movement of the center of the gravity of the baby seated on the seat 20, the seat 20 is reclined, and the rotating members 12 are subjected to a torque (C), which easily results in breakage of the rotating members 12 and, thus, dropping of the seat 20. At this time, since the upper and lower ends of the booms 16 are connected respectively and pivotally to the corresponding rotating member 12 and the seat 20, if the seat 20 is continued to swing, the booms 16 will rotate about the rotating members 12 and the engaging members 182. Hence, torsion stress is received by both the rotating members 12 and the booms 16. That is, stress concentration on the rotating members 12 can be avoided to prevent breakage of the same to thereby increase the service life of the baby swing and avoid dropping of the seat 20, thereby promoting safety during use of the baby swing.

In an alternative embodiment, the height-adjusting devices 14 may be omitted.

With this invention thus explained, it is apparent that numerous modifications and variations can be made without departing from the scope and spirit of this invention. It is therefore intended that this invention be limited only as indicated by the appended claims.

I claim:

1. A baby swing comprising:

a pair of frames, a pair of connecting members, a pair of rotating members, a pair of booms, and a seat, said frames being interconnected by said connecting members, said rotating members being connected respectively and pivotally to said connecting members, each of said booms having two ends connected respectively to a corresponding one of said rotating members and said seat so as to allow for forward and rearward swinging movement of said seat relative to said frames, wherein one of said two ends of each of said booms is connected pivotally to a corresponding one of the corresponding one of said rotating members and said seat;

wherein the one of said two ends of each of said booms is pivotally connected about a first axis to the corresponding one of said rotating members, and the other of said two ends of each of said booms is connected pivotally about a second axis to said seat, so as to allow for leftward and rightward swinging movement of said seat relative to said booms; wherein said first axis and second axis are parallel with respect to each other;

further comprising a pair of pivotal connection units, the other of said two ends of each of said booms being connected pivotally to said seat by a corresponding one of said pivotal connection units;

wherein each of said pivotal connection units includes a connecting piece and an engaging member, each of said booms being mounted to said connecting piece of a corresponding one of said pivotal connection components, said connecting piece being connected pivotally to said engaging member, said engaging member being connected to said seat.

2. The baby swing as claimed in claim 1, wherein the one of said two ends of each of said booms is connected pivotally about said first axis to the corresponding one of said rotating members in a left-to-right direction, and the other of said two ends of each of said booms is connected pivotally about said second axis to said seat in the left-to-right direction.

3. The baby swing as claimed in claim 1, wherein each of said pivotal connection units further includes a mounting member mounted to said seat and having an insert portion, said engaging member being formed with a plurality of engaging grooves, said insert portion being inserted into a selected one of said engaging grooves.

4. The baby swing as claimed in claim 3, wherein each of said pivotal connection units further includes a resilient member for biasing said insert portion into the selected one of said engaging grooves.

5. The baby swing as claimed in claim 1, further comprising a plurality of height-adjusting devices connected to said frames and operable to adjust heights of said frames.

* * * * *

UNITED STATES PATENT AND TRADEMARK OFFICE

CERTIFICATE OF CORRECTION

PATENT NO. : 8,900,063 B2
APPLICATION NO. : 13/237613
DATED : December 2, 2014
INVENTOR(S) : Lin It is certified that error appears in the above-identified patent and that said Letters Patent is hereby corrected as shown below:

On the title page item [73], delete "Wonderland Nurseygoods Company Limited, Hong Kong (HK)" insert -- Wonderland Nurserygoods Company Limited, Central Hong Kong (HK) --.

Signed and Sealed this
Tenth Day of May, 2016

Michelle K. Lee

Michelle K. Lee
*Director of the United States Patent and Trademark Office*